US010709190B2

(12) United States Patent
Brachos et al.

(10) Patent No.: US 10,709,190 B2
(45) Date of Patent: Jul. 14, 2020

(54) BALLISTIC PROTECTION LAYER FOR HELMET PAD SYSTEM

(71) Applicant: Avon Rubber P.L.C., Melksham, Wiltshire (GB)

(72) Inventors: Vasilios Brachos, North Andover, MA (US); Vincent Borbone, Hampstead, NH (US)

(73) Assignee: Avon Rubber P.L.C., Melksham, Wiltshire (GB)

( * ) Notice: Subject to any disclaimer, the term of this patent is extended or adjusted under 35 U.S.C. 154(b) by 0 days.

(21) Appl. No.: 16/310,334

(22) PCT Filed: Jun. 5, 2017

(86) PCT No.: PCT/US2017/035915
§ 371 (c)(1),
(2) Date: Dec. 14, 2018

(87) PCT Pub. No.: WO2017/218224
PCT Pub. Date: Dec. 21, 2017

(65) Prior Publication Data

US 2019/0328070 A1 Oct. 31, 2019

Related U.S. Application Data

(60) Provisional application No. 62/351,053, filed on Jun. 16, 2016.

(51) Int. Cl.

| | |
|---|---|
| ***A42B 3/12*** | (2006.01) |
| ***A42B 3/06*** | (2006.01) |
| ***F41H 1/08*** | (2006.01) |

(52) U.S. Cl.
CPC ..... *A42B 3/12* (2013.01); *A42B 3/063* (2013.01); *F41H 1/08* (2013.01)

(58) Field of Classification Search
CPC ..... A42B 3/12; A42B 3/31063; F41H 1/08
USPC ..... 2/414
See application file for complete search history.

(56) References Cited

U.S. PATENT DOCUMENTS

| | | | | |
|---|---|---|---|---|
| 3,906,546 A | | 9/1975 | Gooding | |
| 4,023,209 A | * | 5/1977 | Frieder, Jr. | A42B 3/166 2/6.6 |
| 4,457,985 A | * | 7/1984 | Harpell | A42B 3/062 442/301 |

(Continued)

FOREIGN PATENT DOCUMENTS

| | | |
|---|---|---|
| CN | 105645840 | 6/2016 |
| DE | 102015003378 | 9/2016 |

(Continued)

OTHER PUBLICATIONS

International Search Report for PCT International Application No. PCT/US2017/035915, dated Jul. 14, 2015, 6 pages.

*Primary Examiner* — Gloria M Hale
(74) *Attorney, Agent, or Firm* — McGarry Bair PC

(57) ABSTRACT

The present application relates to helmet pads (120) comprising a ballistic protection layer (126). It also relates to a ballistic helmet (100) that comprises a helmet pad comprising a ballistic protection layer. Further, the present application also relates to a helmet pad replacement set wherein one or more of the replacement helmet pads comprises a ballistic protection layer.

6 Claims, 2 Drawing Sheets

(56) References Cited

U.S. PATENT DOCUMENTS

| | | | | |
|---|---|---|---|---|
| 5,522,091 | A * | 6/1996 | Rudolf | A42B 3/069 2/414 |
| 9,204,678 | B1 * | 12/2015 | Brachos | A42B 3/147 |
| 2002/0002730 | A1 * | 1/2002 | Dennis | A42B 3/12 2/411 |
| 2007/0238405 | A1 | 10/2007 | Arai | |
| 2008/0000015 | A1 | 1/2008 | Sutter | |
| 2011/0072562 | A1 | 3/2011 | Prendergast | |
| 2014/0020159 | A1 * | 1/2014 | Teetzel | A42B 3/04 2/422 |
| 2015/0223546 | A1 | 8/2015 | Cohen | |
| 2016/0069649 | A1 * | 3/2016 | Harings | F41H 5/0485 89/36.02 |

FOREIGN PATENT DOCUMENTS

| | | |
|---|---|---|
| WO | 2005-049109 | 6/2005 |
| WO | 2014-160362 | 10/2014 |

* cited by examiner

BALLISTIC PROTECTION LAYER FOR HELMET PAD SYSTEM

CROSS REFERENCE TO RELATED APPLICATIONS

This application is a national stage filing under 35 U.S.C. 371 of PCT/US2017/035915, filed Jun. 5, 2017, which claims the benefit of Provisional Application No. 62/351,053, filed Jun. 16, 2016, the disclosure of which is incorporated by reference in their entirety herein.

FIELD

The present disclosure relates to a helmet pad incorporating a layer spall and/or ballistic fragment protection.

BACKGROUND

In designing ballistic helmets there is an ongoing desire to attach peripheral elements such as equipment rails, night vision goggles and night vision goggle shrouds, communication devices, hearing protection devices, and the like.

On the one hand, companies such as 3M have been technology leaders in designing ballistic helmets that allow for connecting such peripheral elements without penetrating the helmet's ballistic layer. On the other hand, helmets are still made, whether for ease of manufacturing, cost, weight, or flexibility of design, with through-holes and connection points that penetrate the helmet ballistic layer. When such sites of ballistic layer compromise are present, it is required that any peripheral element connected through such through-hole be connected with ballistic rated connection elements.

SUMMARY

Applicants have found that, despite the use of ballistic rated connection elements in ballistic helmets with ballistic layer through-holes, there remains the danger of fragmentation of such connection elements and/or spall production when such sites experience ballistic trauma (i.e., they are shot).

An aspect of the present disclosure relates to a helmet pad comprising a ballistic protection layer (that is, a layer for stopping or slowing spall and/or ballistic fragment). Such helmet pad may be designed, for instance, to be placed behind a ballistic layer through-hole in a ballistic helmet.

In another aspect, the present disclosure relates to a ballistic helmet that comprises a helmet pad comprising a ballistic protection layer.

In yet another aspect, the present disclosure relates to a helmet pad replacement set wherein one or more of the replacement helmet pads comprises a ballistic protection layer.

BRIEF DESCRIPTION OF THE DRAWINGS

The above-mentioned and other features of this disclosure, and the manner of attaining them, may become more apparent and better understood by reference to the following 10 description of embodiments described herein taken in conjunction with the accompanying drawings, wherein.

DETAILED DESCRIPTION

As noted above, in designing ballistic helmets there is an ongoing desire to attach peripheral elements such as equipment rails, night vision goggles and night vision goggle shrouds, communication devices, hearing protection devices, and the like.

On the one hand, companies such as 3M have been technology leaders in designing ballistic helmets that allow for connecting such peripheral elements without penetrating the helmet's ballistic layer. On the other hand, helmets are still made, whether for ease of manufacturing, cost, weight, or flexibility of design, with through-holes and connection points that penetrate the helmet ballistic layer. When such sites of ballistic layer compromise are present, it is required that any peripheral element connected through such through-hole be connected with ballistic rated connection elements.

The present applicants have found that, despite the use of ballistic rated connection elements in ballistic helmets with ballistic layer through-holes, there remains the danger of fragmentation of such connection elements and/or spall production when such sites experience ballistic trauma (i.e., they are shot). In response, applicants have developed an ingenious way of dealing with the dangers from such fragmentation and/or spall production using the helmet pads, helmets, and replacement pad sets according to the present description.

The helmet pads, helmets, and replacement pad sets described herein address the limitations of conventional approaches to dealing with the dangers of having through-holes in ballistic helmets. While the approaches described herein may not obviate the need for using ballistic grade materials for points of connection in through-holes, they do increase the safety of the wearer in the event of ballistic trauma. Further, while the helmet pads, helmets, and helmet pad replacement sets are described herein as decoupleably affixed or affixable to one another, such decoupleability is desirable, but not required. That is, conventional ballistic helmets are designed so that the helmet pads are capable of being decoupled from the helmet shell, but that is not necessary to enjoy the benefits of the presently described solutions.

Accordingly, in some embodiments, the present disclosure relates to helmet pads, ballistic helmets and/or helmet pad replacement sets that are capable of providing ballistic protection levels and may be useful for military, police, combat and other applications where ballistic protection is desirable.

As noted above, the helmet pads provided herein comprise a ballistic protection layer. Accordingly, for instance, the ballistic protection layer may be provided as a separate or discrete layer in the helmet pad, for instance, contained in the same cover.

Figure 1:
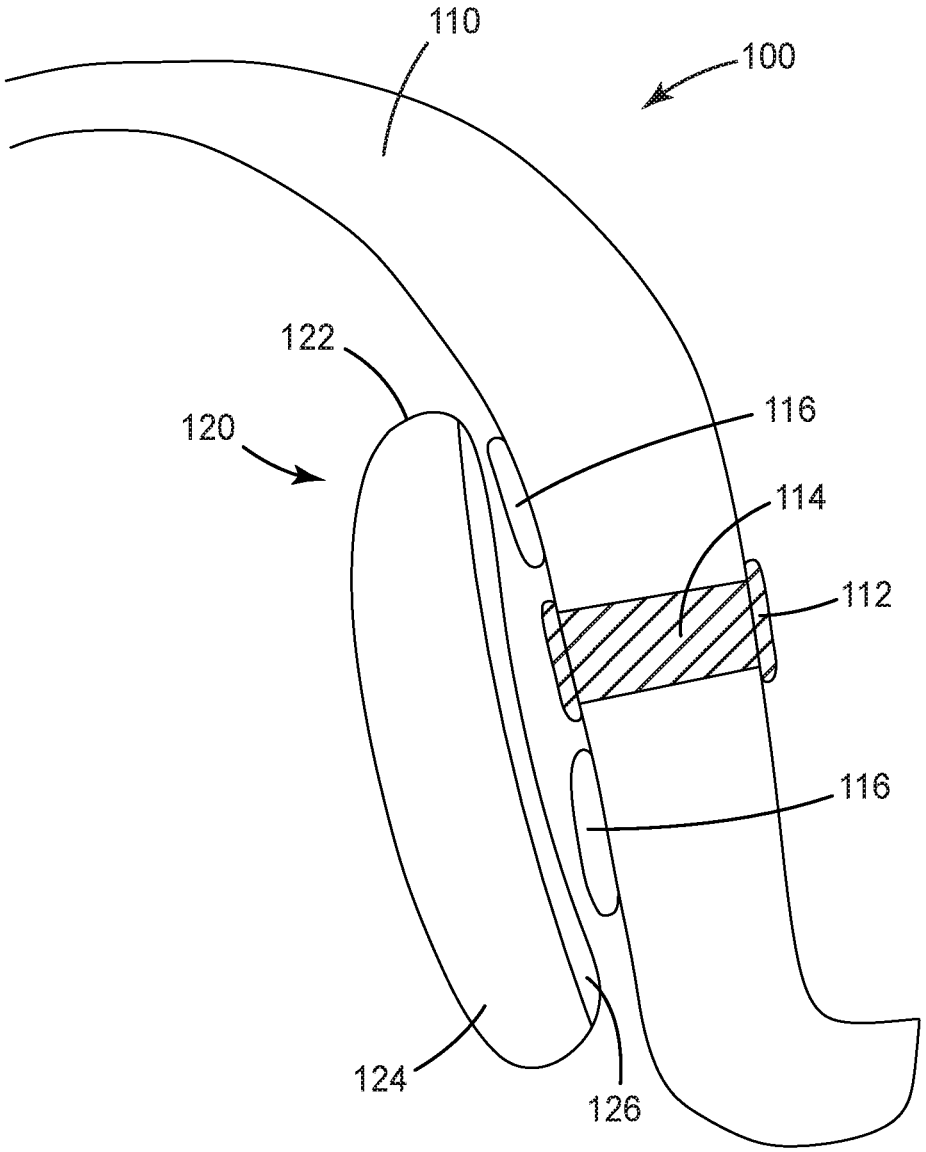
FIG. 1 illustrates a partial cross-sectional view of an embodiment of a helmet including a ballistic shell, a helmet pad comprising a ballistic protection layer, which pad is separable from the ballistic shell, a mechanical fastener decouple-ably securing the helmet pad to the ballistic shell, and an energy absorbent layer.

In FIG. 1, ballistic protection layer 126 may be included within helmet pad 120 and may fall within helmet pad cover 122 along with energy absorbent layer 124. This arrangement allows ballistic protection layer 126 to catch or slow any spall or fragmentation from a ballistic trauma to the area surrounding or including ballistic grade fastener 112 and/or through-hole 114. Applicants have observed that, in the absence of ballistic protection layer 126, such spall or fragmentation from a ballistic trauma may penetrate energy absorbent layer 124, causing injury to the wearer.

Helmet pad 120 may be placed anywhere on the inside of ballistic helmet 100, but is most useful when placed behind through hole 114 and ballistic grade fastener 112. In general, ballistic helmets may include through-holes and/or ballistic grade fasteners at points of connection of auxiliarly components such as equipment rails, night vision goggle shrouds, retention systems (e.g., chin-straps), and the like.

The helmet pads may be connected to the ballistic helmets by any conventional means. As it is the most common practice in the industry, FIG. 1 shows helmet pad 120 connected via hook and loop 116. Other less common approaches may include adhesive, button, and any other means of mechanical or chemical fastening or fixing of the helmet pad to the ballistic helmet. When hook and loop is used, the material for helmet pad cover 122 should be chosen so as to provide a secure connection mating to hook and loop 116.

Helmet shell 110 and ballistic protection layer 126 may each be formed of polymeric materials including thermoplastic, thermoset or both, made into a composite structure. In some embodiments, helmet shell 110 and ballistic protection layer 126 is made from the same polymeric material, it is not necessary, and they may be chosen as different materials, taking into account the weight of the materials, the cost, the required ballistic performance, and the like.

While composites are typically understood to include two or more materials, as understood herein with regard to helmet shell 110 and ballistic protection layer 126, composites include multiple layers of one or more materials stacked and consolidated together through the use of heat, pressure, adhesives, matrix materials or combinations thereof. In embodiments, the composites include woven or non-woven fabrics or films. When employed herein, the fabrics are formed of fibers or yarns including materials, such as, but not limited to, ultra-high molecular weight polyethylene (UHMWPE) such as DYNEEMA available from DSM or SPECTRA available from Honeywell; para-aramid material such as KEVLAR available from DuPont or TWARON available from Teijin-Aramid; polyamide; polyester; or combinations thereof. From 1 to 100 layers of fabric or film may be included within a stack (for a helmet shell, from 8 to 100 is more commont), including all values and ranges therein.

In embodiments, the fibers for forming helmet shell 110 and/or ballistic protection layer 126 may include relatively low density fibers exhibiting a density of less than 1.20 grams per cubic centimeter (such as UHMWPE) as well as relatively high density fibers exhibiting a density of up to 1.60 grams per cubic centimeter (such as Kevlar), including all values and ranges from 0.80 grams per cubic centimeter to 1.60 grams per cubic centimeter. The fibers may also exhibit an elongation at break in the range of greater than 2.5% and up to 5%, including all values and ranges therein, such as 3% to 5%, etc. In addition, the fibers may exhibit a tenacity, which is understood as the force per unit of linear density of an unstrained specimen, of greater than 25 gpd, such as from 25 gpd to 50 gpd, including all values and ranges therein, such as 25 gpd to 45 gpd. The elastic modulus of the fibers may be in the range of 600 gpd to 2500 gpd, including all values and ranges therein. The fibers may exhibit a combination of any two or more of the above characteristics as well.

In the context of helmet shell 110, fibers exhibiting one or more of the above properties may form 50% by weight or more of the total weight of the helmet shell, including all values and ranges from 50% by weight to 100% by weight, including all values and ranges therein, including 75% by weight to 95% by weight, 80% by weight to 100% by weight, 90% by weight to 100% by weight, etc. The properties described above, and further below, may be determined by ASTM testing protocols including, for example ASTM-D638-10, ASTM D3822-07, ASTM D3217-07, ASTM C1557-03 and combinations thereof.

In embodiments, the helmet shell is understood to be a ballistic helmet shell and exhibits a V50 of 300 meters per second or greater at 0°, including all values and ranges from, for example 300 to 1100 meters per second. The V50 is understood as the velocity at which 50% of shots fired may pass through or penetrate a substrate of given grain fragment size (in the present case a 17 grain FSP steel fragment), such as described in MIL STD-662F V50 (1997) and tested according thereto. Embodiments of helmets and helmet shells may include the enhanced combat helmet available from Ceradyne, Inc., Costa Mesa, Calif.

Figure 2:
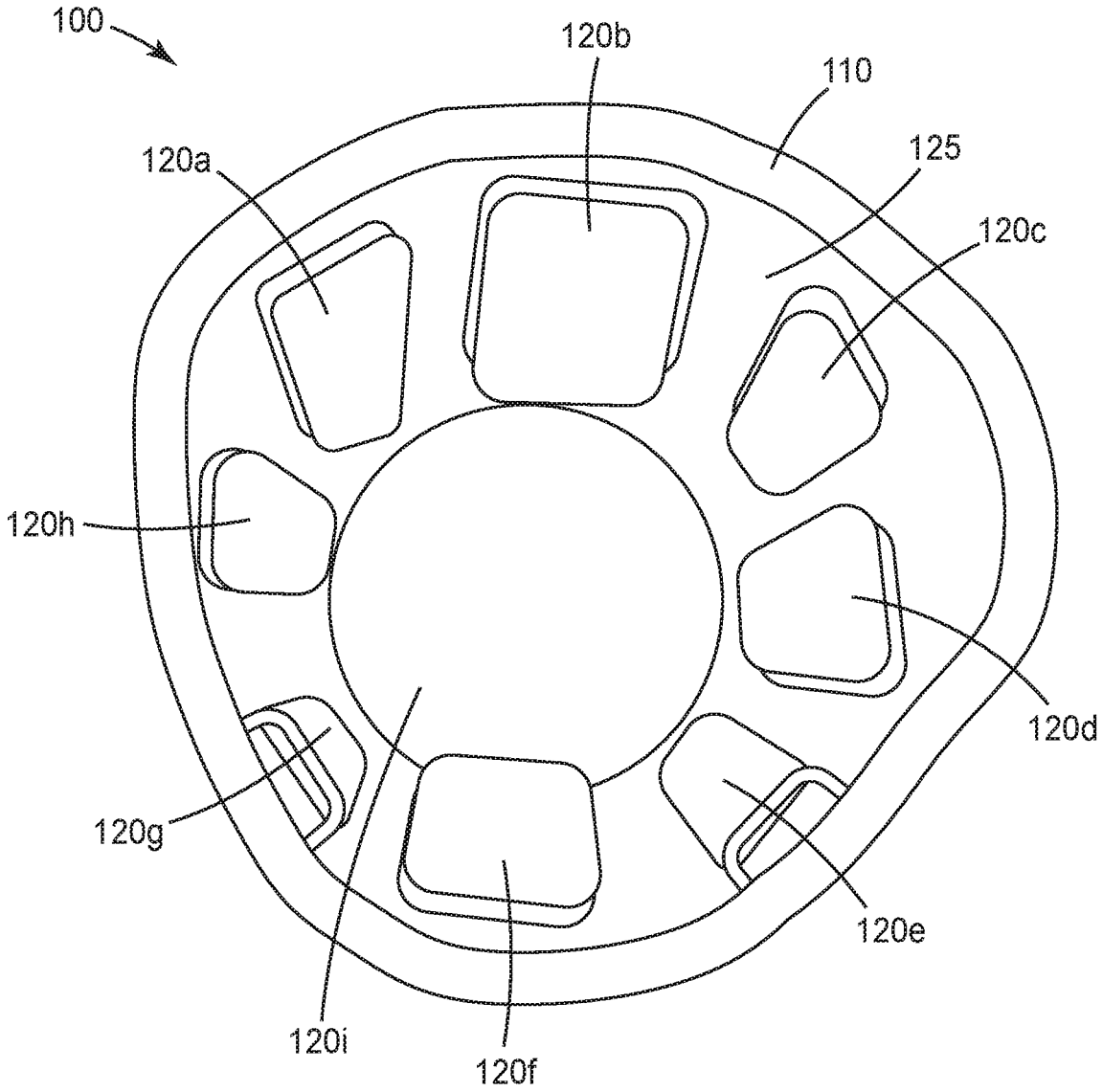
FIG. 2 illustrates a bottom view of a ballistic helmet including a number of helmet pads affixed to the interior surface of the helmet shell.

As illustrated in FIG. 2, a number of helmet pads **120*a*-120*i*, (referred to colloquially in the industry and herein collectively as a suspension system), may be positioned within helmet shell 110. Any number of helmet pads may be provided within the helmet 100 covering from 10% to 100% of the inner surface area 125 of the helmet shell 110**, including all values and ranges therein, such as 50% to 95% of the inner surface area, etc. Such helmet pads are traditionally used to provide comfort as well as protection from blunt force impact. As described herein, the presently disclosed helmet pads also provide ballistic protection to the wearer.

Where more than one helmet pad is provided, the helmet pads may be positioned in discrete locations around the inner surface of the shell. In some examples, a seven pad configuration may be used with three pads positioned in the rear of the helmet, three in the front of the helmet and one at the crown. In other examples, a three pad system may be used, one in the front, one in the rear and one at the crown. In further examples, a single helmet pad may be provided as a layer that covers all or a portion of the inner surface area of the shell.

The helmet pads 120 are understood as compressible pads that deflect upon the application of force, absorbing energy. In embodiments, the helmet pads exhibit a compression force deflection of 5 to 200 kPa upon the application of a 25% strain at a rate of 0.2 inches per minute. Such measurements may be made according to ASTM D-3575-08.

The helmet pads 120 may be formed from foam, thermoplastic sheets formed with impact absorbing geometries, or foam and thermoplastic sheet composites wherein the composites may include at least one layer of foam and one or more layers of a thermoplastic sheet, with or without impact absorbing geometries. The foam may be open cell or closed cell foam. Open cell foam may be understood as foam which includes a substantial portion of cells, at least 40% by volume, which have cell walls with openings connecting adjacent cells. Closed cell foams may be understood as foam wherein at least 40% by volume of the cells are isolated from or completely closed to adjacent cells. The foam may be formed from polyurethane or silicone materials, such as ZORBIUM available from TEAM WENDY or PORON available from Rogers Corporation.

In addition, when thermoplastic sheet material is used, the thermoplastic sheet material may include polyolefins, polystyrene, acrylic, polycarbonate, polyesters, polyamide including aliphatic, aromatic and semi-aromatic polyamides, copolymers or blends thereof.

One or more helmet pads are positioned in the helmet shell between the wearer's head and the helmet shell and relative to a through-hole and/or ballistic grade fastener so as to at least partially, and in embodiments completely, cover such through-hole and/or ballistic grade fasterner. Stated another way, when there is a through-hole and/or ballistic grade fastener that penetrates the helmet shell, a helmet pad is provided between the wearer's head and such through-hole and/or ballistic grade fastener. In this manner, the present invention may increase the safety of the wearer by protecting against fragmentation and/or spall produced by ballistic trauma at the through-hole and/or ballistic grade fastener, which is a weak-point in the helmet shell.

According to the above, provided herein are helmet pads comprising a ballistic protection layer (that is, a layer for stopping or slowing spall and/or ballistic fragment). Such helmet pad may be designed, for instance, to be placed behind a ballistic layer through-hole in a ballistic helmet.

In another aspect, the present disclosure relates to a ballistic helmet that comprises a helmet pad comprising a ballistic protection layer.

In yet another aspect, the present disclosure relates to a helmet pad replacement set wherein one or more of the replacement helmet pads comprises a ballistic protection layer. Such replacement set may be useful, for instance, in retrofitting a ballistic helmet that was originally manufactured with helmet pads lacking the ballistic protection layer described herein.

Exemplary embodiments include the following:

Embodiment 1

A helmet pad comprising a ballistic protection layer.

Embodiment 2

The helmet pad of embodiment 1 wherein the ballistic protection layer comprises a first material selected from the group consisting of ultra-high molecular weight polyethylene, para-aramid, polyamide, polyester, and a combination thereof.

Embodiment 3

The helmet pad of embodiment 1 or 2, wherein the ballistic protection layer comprises from 1 to 100 layers of first material.

Embodiment 4

The helmet pad of any of the previous embodiments further comprising an energy absorbent layer adjacent to the ballistic protection layer and a helmet pad cover enclosing the ballistic protection layer and the energy absorbent layer.

Embodiment 5

A ballistic helmet comprising a helmet pad, the helmet pad comprising a ballistic protection layer.

Embodiment 6

The ballistic helmet of embodiment 5 wherein the ballistic helmet comprises a helmet shell having an inner surface area;

the helmet pad further comprises an energy absorbent layer adjacent to the ballistic protection layer; and the ballistic protection layer is disposed between the inner surface area and the energy absorbent layer.

Embodiment 7

The ballistic helmet of embodiment 6 wherein the helmet shell comprises a helmet shell through-hole.

Embodiment 8

The ballistic helmet of embodiment 7 wherein the helmet pad is positioned so as to at least partially cover the helmet shell through-hole.

Embodiment 9

The ballistic helmet of embodiment 8 wherein the helmet pad is positioned so as to completely cover the helmet shell through-hole.

Embodiment 10

The ballistic helmet of embodiment 8 wherein the helmet shell through-hole has a ballistic grade fastener extending through it.

Embodiment 11

The ballistic helmet of embodiment 10 further comprising a night vision goggle shroud, wherein the ballistic grade fastener secures the night vision goggle shroud to the ballistic helmet.

Embodiment 12

The ballistic helmet of embodiment 10 further comprising an equipment rail, wherein the ballistic grade fastener secures the equipment rail to the ballistic helmet.

Embodiment 13

A helmet pad replacement set comprising a replacement pad, wherein the replacement pad comprises a ballistic protection layer.

The invention claimed is:

1. A ballistic helmet comprising:

a helmet shell having an inner surface area and at least one through hole, and a helmet pad removably connectable to the helmet shell, and comprising a ballistic protection layer having from 1 to 100 layers of a first material selected from the group consisting of ultra-high molecular weight polyethylene, para-aramid, polyamide, polyester, or a combination thereof and an energy absorbing layer adjacent to the ballistic protection layer, wherein when the helmet pad is connected to the helmet shell, the ballistic protection layer is disposed between the inner surface area and the energy absorbent layer so as to at least partially cover the at least one helmet shell through-hole and the energy absorbent layer is disposed adjacent a wearer of the ballistic helmet.

2. The ballistic helmet of claim 1 wherein the helmet pad is positioned so as to completely cover the helmet shell through-hole.

3. The ballistic helmet of claim 1 wherein the helmet shell through-hole has a ballistic grade fastener extending through it.

4. The ballistic helmet of claim 3 further comprising a night vision goggle shroud, wherein the ballistic grade fastener secures the night vision goggle shroud to the ballistic helmet.

5. The ballistic helmet of claim 3 further comprising an equipment rail, wherein the ballistic grade fastener secures the equipment rail to the ballistic helmet.

6. The ballistic helmet of claim 1, further comprising a helmet pad cover enclosing the ballistic protection layer and the energy absorbent layer.

* * * * *